United States Patent [19]

Niemiro et al.

[11] Patent Number: 4,901,640

[45] Date of Patent: Feb. 20, 1990

[54] OSCILLATING FORM ROLLER DAMPENER

[75] Inventors: Thaddeus A. Niemiro, Lisle; Daniel R. Zimich, Cicero, both of Ill.

[73] Assignee: Rockwell International Corporation, Pittsburgh, Pa.

[21] Appl. No.: 262,853

[22] Filed: Oct. 19, 1988

[51] Int. Cl.[4] ..... B41L 25/00

[52] U.S. Cl. ..... 101/148; 101/349

[58] Field of Search ..... 101/147, 148, 349

[56] References Cited

U.S. PATENT DOCUMENTS 1,012,485 12/1911 Waite ..... 101/147

3,994,222 11/1976 Pullen ..... 101/349

4,385,559 5/1983 Jarach ..... 101/148

4,708,058 11/1987 Smith ..... 101/147

4,809,606 3/1989 Day et al. ..... 101/148

*Primary Examiner*—Edgar S. Burr

*Assistant Examiner*—Ren Yan

[57] ABSTRACT

An improved structure for supplying dampening fluid to a lithographic printing press which structure includes a form roller for passing fluid to the plate cylinder and means mounting the form roller for simultaneous contact with the water drum and the plate cylinder and also means for oscillating the form roller slowly axially with respect to the plate cylinder and the water drum.

5 Claims, 2 Drawing Sheets

OSCILLATING FORM ROLLER DAMPENER

This invention relates to an offset printing press and more particularly to an offset press in which form and rider rollers in the press dampening system can be oscillated laterally between press side frames to distribute ink from non-print to print areas on the plate cylinder.

Offset lithographic presses have usually utilized series of cooperating rollers to introduce the required water and ink onto the plate roll for the printing operation. Many times the series of rollers were quite lengthy to insure proper milling of the ink and distribution of the water. In addition to utilization of long trains of ink and water rollers, many times provision was included for axial vibration of one or more rollers to further assist mechanical preparation and/or distribution of the printing materials. Existing examples of presses incorporating constructions permitting axial vibration of ink or water rollers may be found by referring to U.S. Pat. Nos. 2,300,549; 4,385,559, and 4,429,630.

Offset lithography operates through use of essentially planar printing plates that are processed to provide areas on the plate that attract and/or repel preferentially water or ink. Those areas that attract ink and repel water are, of course, the areas that are responsible for the deposition of ink onto the press plate cylinder for transfer to the blanket cylinder and from a paper web thereto.

A large percentage of present day printed products; newspapers, magazines and related publications, for example, entails printing in columns. Offset printing plates are usually comprised of eight columns with each column being separated from adjoining columns by a circumferential non-printing zone. During printing runs, therefore, there is a build up or accumulation of ink in all of the circumferential non-printing zones, which ultimately results in printed products of unacceptable quality.

It is a principal object of this invention to provide an improved offset press construction in which build-up of ink in the circumferential non-print areas of the printing plate is eliminated.

Another object of this invention is to provide an improved mounting for an offset press form roller that permits slow axial oscillation of a form roller against the press plate cylinder.

Yet another object of this invention is to provide a form roller mounting that is carried on the shaft of the water drum and can be oscillated axially with respect thereto.

An additional object of this invention is to provide form and rider rollers in a press water supply train that can be oscillated axially with respect to the water drum.

Additional objects and advantages of this invention will be in part obvious and in part explained by reference to the accompanying specification and drawings, in which:

FIG. 1 is a partly schematic broken front elevation showing the manner in which the form and rider rollers are mounted for oscillation with respect to the press water drum; and FIG. 2 is a partly schematic side elevation showing the form roller and rider roller mounting structure.

DESCRIPTION OF THE PREFERRED EMBODIMENT

Figure 1:
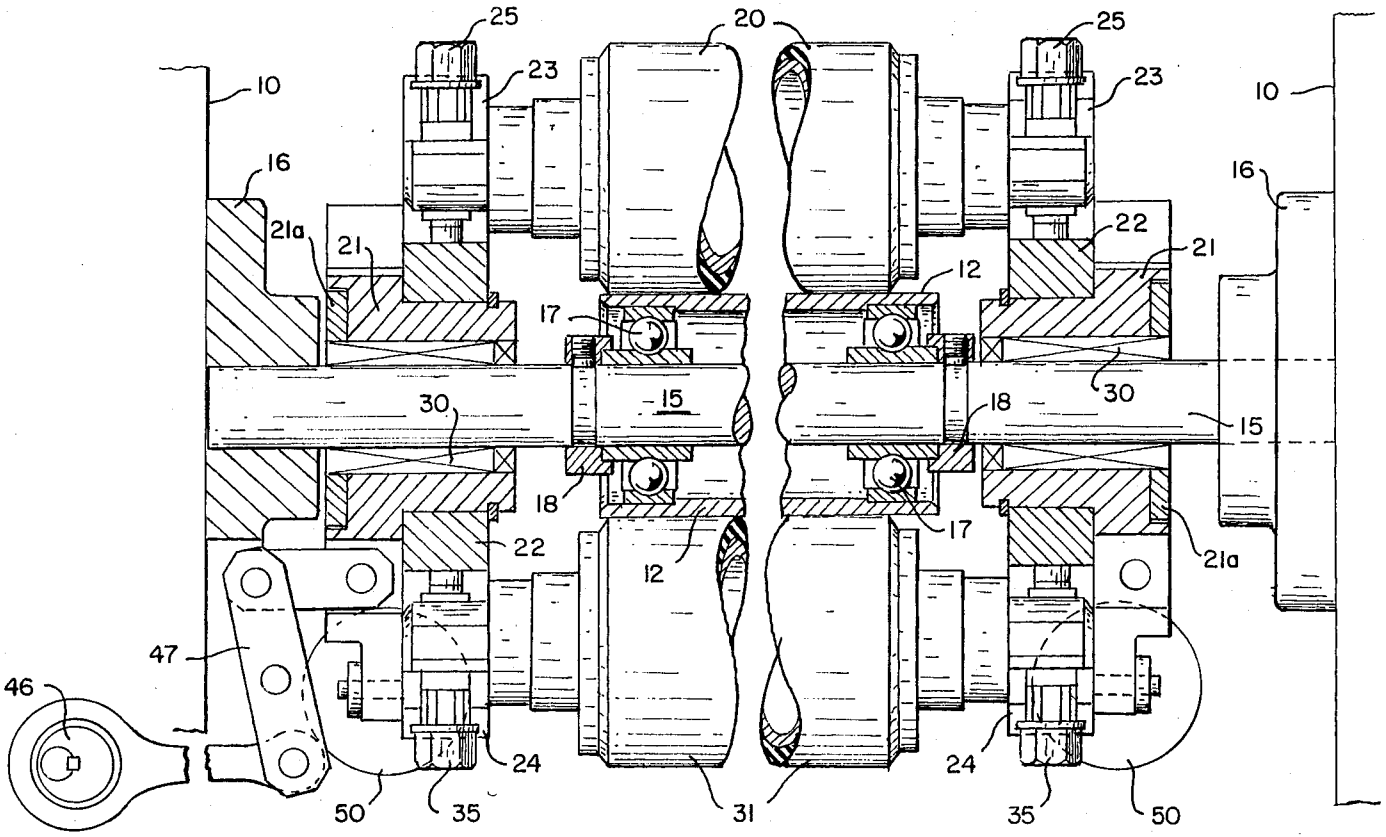
Figure 2:
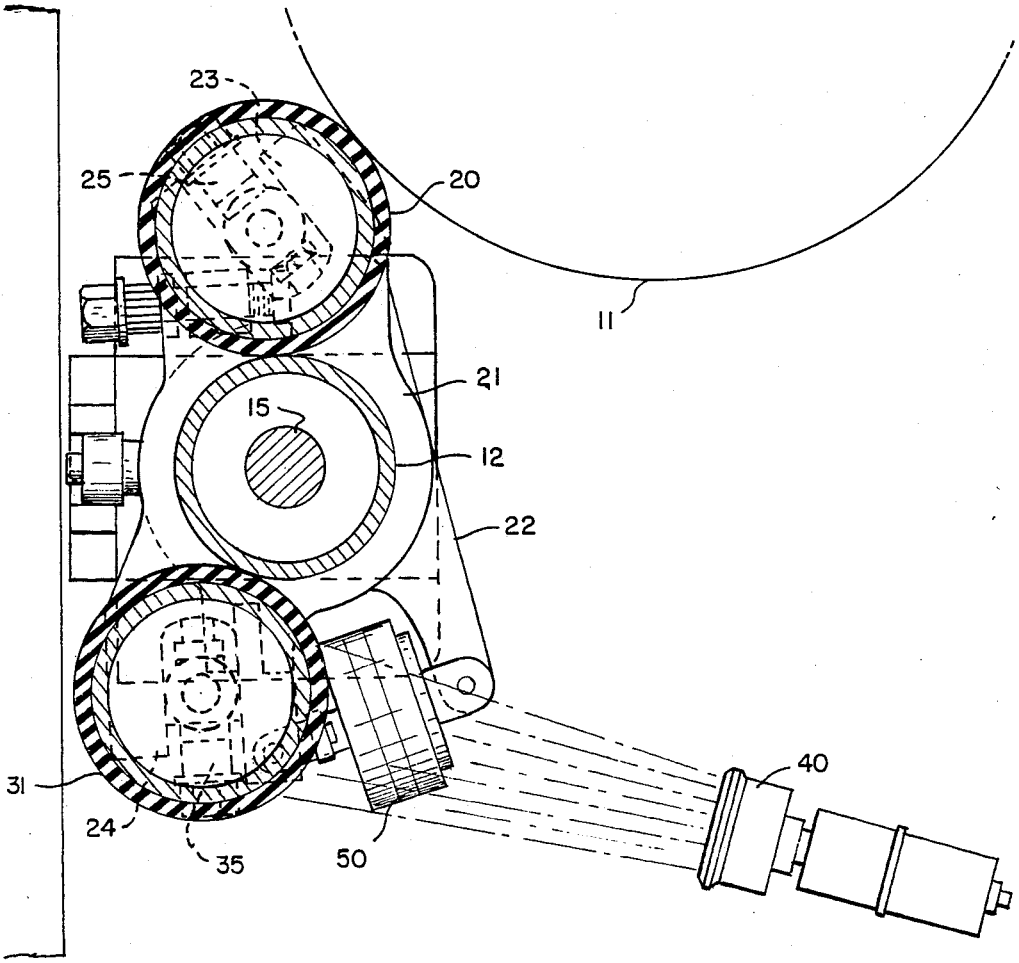

In order to better understand the exact nature of the present invention, reference is made to the figures of the drawings and more particularly to FIG. 1. In FIG. 1, the numeral 10 designates the side frame members of a press, these frame members providing the principal support for most of the rolls and shafts of the press that are journaled therein. Mounted for rotation between the side frame members are a plate cylinder 11, only a portion of which is shown in FIG. 2 of the drawings, and a water drum 12. The water drum 12 is a roll which has an exterior layer of chrome of ceramic material which is hydrophilic so that the water that is present will become more uniformally dispersed for subsequent transfer. The water drum 12 is mounted for rotation on a shaft 15 that has its ends contained within journals 16 attached to side frame 10. The shaft 15 is stationary but the water drum 12 is mounted rotatably on shaft 15 and by means of the frictionless bearings 17. Retaining rings 18 are secured to the shaft 15 in the appropriate position to hold the water drum 12 in its preselected position between frame members 10.

The present invention also contemplates a form roller 20 which is arranged for contact with the plate cylinder 11 when it is located in its operative position. The form roller 20 is supported by mounting means 21 which in the form shown is a plate like element 22 that has upwardly and downwardly extending lobes 23 and 24, respectively. Between the upwardly extending lobes the form roller 20 is held in position by means of threaded fasteners 25 acting against the shaft ends of the roll. The fasteners 25 can be adjusted to vary the distance between the form roller and the water roller 12 so that the amount of operating pressure between these rolls can be varied. Mounting means 21 are disposed on the shaft 15. The mounting means 21 are mounted on shaft 15 by means which permit axial movement of the mounting means parallel to the axis of the shaft of the water drum. The mounting means may comprise a linear bearing such as indicated by the numeral 30 or any other form of sleeve bearing that will permit axial movement. The mounting means 21 is shown being locked in position on the bearing means 30 by means of locking rings 21a.

As the drawings indicate, the downwardly extending portion 24 of mounting means 21 has a rider roller 31 mounted on it in the same fashion as the form roller 20 is mounted, specifically by means of fasteners 35 that attach directly to the mounting means 21. The rider roller 31 is covered with some sort of water absorbing material such as rubber or fabric and is used to receive water from a source of water such as the nozzle 40 and pass it on to the water drum 12 and from there on to the form roller 20 for deposition on the surface of plate cylinder 11. It should be noted at this point that the rider roller may or may not be present in all installations. Where the water or dampening solution is to be applied to the plate before the ink is applied, the rider roller 31 can be removed and the spray from nozzle 40 can be applied directly to the water drum 12. It is only when the ink is applied to the plate prior to the application of dampening fluid that the rider roller 31 is required.

It will thus be seen that the mounting means 21 contains both the mounts for the form roller 20 and for the rider roller 31 so that by oscillating the mounting means to and fro between the opposite side frame members 10 the form and rider rollers will both also reciprocate. Reciprocating is effected by means of the drive means shown in FIG. 1. Specifically, a drive motor, not shown, has an eccentric 46 connected through linkage 47 to one of the mounting means 21. The rider roller 31 and the form roller 20 are oscillated at a slow rate for example at one cycle about every 30 seconds at a press operational speed of 50,000 impressions per hour. A DC motor is adequate to effect this mode of reciprocation.

Referring to FIG. 2 it will be noted that means are provided for rocking the mounting means 21 about the axis of the water drum 12. This means comprises a throw off cylinder 50 which is connected on one end to the mounting means 21 and at the other end to the side frame of the press. By tilting the mounting means 21 through action of the throw-off cylinder 50 the form roller can be moved out of contact with the plate cylinder or into contact with the plate cylinder, whichever position is desired.

This invention is intended to cover all changes and modifications of the invention herein described and claimed and such changes and modifications are within the spirit and scope of the present invention.

We claim:

1. In an offset printing press having spaced apart side frame members, a plate cylinder mounted on the side frame members for rotation between said side frame members, a water drum shaft disposed parallel to the axis of rotation of the plate cylinder and radially spaced from the plate cylinder, said shaft being supported by and extending between said spaced apart side frame members, a water drum having a water receptive hydrophilic surface mounted on said shaft for rotation, said water drum being mounted on said shaft in a fixed position between and spaced from each of said side frame members, and a press dampening system comprising: said water drum;

(a) a form roller;

(b) two mounting means, one at each end of said form roller, rotatably supporting said form roller, between the side frame members, adjacent and parallel to the axes of the plate cylinder and the water drum;

(c) bearing means supporting each of said mounting means on said water drum shaft located between the ends of said water drum and the adjacent side frame members, to permit movement of said form roller mounting means, with said form roller, along a path parallel to the axis of said water drum shaft; and (d) drive means connected to at least one of said form roller mounting means to reciprocate said form roller mounting means, with said form roller, between the side frames at a slow rate to thereby direct ink from non-print zones on the plate cylinder toward print zones present thereon.

2. The combination as defined in claim 1 wherein said press dampening system further comprises: a rider roller rotatably supported by said form roller mounting means, adjacent to and on the opposite side of said water drum from said form roller, to receive water from a source thereof and to reciprocate with said form roller mounting means and said form roller.

3. The combination as defined in claim 2 wherein said drive means comprises a motor driving an eccentric connected by mechanical linkage to said form roller mounting means.

4. The combination as defined in claim 1 wherein said bearing means supporting said form roller mounting means is a linear bearing.

5. The combination as defined in claim 1 wherein throw off means is connected to said form roller mounting means to selectively rotate said mounting means about the axis of the water drum to move said form roller into and out of contact with the plate roll.

* * * * *